US008156603B2

(12) United States Patent
Tsutanaga et al.

(10) Patent No.: US 8,156,603 B2
(45) Date of Patent: Apr. 17, 2012

(54) CLEANING TOOL

(75) Inventors: Hajime Tsutanaga, Fukuoka (JP); Jun Uragami, Fukuoka (JP); Toshihiko Uenishi, Fukuoka (JP); Masaho Hayashi, Tokyo (JP); Yoshinori Tanaka, Kanonji (JP)

(73) Assignee: Uni-Charm Corporation, Ehime (JP)

( * ) Notice: Subject to any disclaimer, the term of this patent is extended or adjusted under 35 U.S.C. 154(b) by 0 days.

(21) Appl. No.: 12/042,469

(22) Filed: Mar. 5, 2008

(65) Prior Publication Data

US 2008/0216261 A1 Sep. 11, 2008

(30) Foreign Application Priority Data

Mar. 5, 2007 (JP) ..... 2007-054929

(51) Int. Cl.
*A47L 13/00* (2006.01)

(52) U.S. Cl. ..... 15/229.3; 15/144.4; 15/145; 15/226; 15/227; 15/229.1; 15/229.4

(58) Field of Classification Search ..... 15/229.1, 15/229.3, 229.4, 209.1, 226, 227, 115, 144.1, 15/145
See application file for complete search history.

(56) References Cited

U.S. PATENT DOCUMENTS

| | | | | |
|---|---|---|---|---|
| 5,836,039 | A * | 11/1998 | Rimer | 15/228 |
| 7,779,502 | B2 | 8/2010 | Fujiwara et al. | |
| 2005/0172440 | A1* | 8/2005 | Lin | 15/226 |
| 2006/0010633 | A1* | 1/2006 | Tanaka | 15/229.3 |
| 2006/0130260 | A1* | 6/2006 | Lee | 15/226 |
| 2006/0260082 | A1* | 11/2006 | Bonilla | 15/229.3 |
| 2007/0033761 | A1* | 2/2007 | Yang et al. | 15/226 |

FOREIGN PATENT DOCUMENTS

| | | |
|---|---|---|
| CN | 1775162 | 12/2004 |
| JP | 09-154791 A | 6/1997 |
| JP | 2005-237975 A | 9/2005 |
| WO | WO 2006/127520 A2 | 11/2006 |

OTHER PUBLICATIONS

Mexican Office Action from corresponding Mexican application No. MX/A/2008/003124 dated Feb. 22, 2011.
English translation and Office Action from corresponding Japanese Application No. 2007-054929 dated Aug. 19, 2011, 3 pgs.
Notification of First Office Action from corresponding Chinese Application No. 200810082759.3 dated Jun. 30, 2011, 6 pgs.

* cited by examiner

*Primary Examiner* — Robert Scruggs
(74) *Attorney, Agent, or Firm* — Brinks Hofer Gilson & Lione

(57) ABSTRACT

A cleaning tool that includes an elongate cleaning element holder and a cleaning element to be attached to the cleaning element holder is provided. The cleaning element holder has a grip to be held by a user and two holding elements extending parallel in a longitudinal direction from the grip. The holding elements are adapted to be inserted into an insert region of the cleaning element to thereby hold the cleaning element. The two holding elements of the cleaning element holder can be rotated in parallel toward each other around a longitudinal axis of the cleaning element holder on a rotation axis disposed between the holding elements. As a result, through the rotation of the two holding elements inserted into the insert region, the sectional shape of the cleaning element can be changed in a direction crossing the longitudinal direction of the cleaning element holder.

4 Claims, 6 Drawing Sheets

CLEANING TOOL

CROSS-REFERENCE TO RELATED APPLICATION

The present application claims priority under 35 U.S.C. §119 to Japanese Patent Application No. 2007-054929 filed on Mar. 5, 2007. The content of the application is incorporated herein by reference in its entirety.

BACKGROUND OF THE INVENTION

1. Field of the Invention

The present invention relates to a cleaning tool, and more particularly to a cleaning tool having a cleaning element for wiping a region to be cleaned.

2. Description of the Related Art

Various types of cleaning tools are known with a sheet-type cleaning element for wiping a region to be cleaned. For example, Japanese non-examined laid-open Patent Publication No. 9-154791 discloses a cleaning tool having cleaning fabric and a holder that detachably holds the cleaning fabric inserted into a holding region of the cleaning fabric. This cleaning tool is capable of wiping a region to be cleaned by using the cleaning fabric held via the holder. However, in designing a cleaning tool of this type having a cleaning element, it is required to provide an effective technique for enhancing its cleaning effect.

SUMMARY OF THE INVENTION

Accordingly, it is an object of the invention to provide an effective technique for realizing a higher cleaning effect in a cleaning tool having a cleaning element for wiping a region to be cleaned. The above-described object is achieved by the features of the claimed invention. A cleaning tool according to an embodiment of the invention is used for wiping a region to be cleaned and includes at least a cleaning element holder and a cleaning element. The cleaning element holder is an elongate member. The cleaning element is designed to be attached to the elongate cleaning element holder.

The cleaning element holder has a grip to be held by a user and two holding elements extending parallel in a longitudinal direction from the grip. The holding elements are designed to be inserted into an insert region of the cleaning element to thereby hold the cleaning element. The insert region may be formed by a single insert portion extending elongate or by a plurality of insert portions extending discontinuously.

The two holding elements of the cleaning element holder can be rotated in parallel toward each other around a longitudinal axis of the cleaning element holder on a rotation axis disposed between the holding elements. Thus, through the rotation of the two holding elements inserted into the insert region, the sectional shape of the cleaning element can be changed in a direction crossing the longitudinal direction of the cleaning element holder. In order to realize the "parallel" state of the holding elements here, it is only necessary to create the state in which the two holding elements are arranged in parallel to each other. Thus, the parallel state widely embraces the state in which the holding elements extend substantially in the same direction, and the state in which the holding elements extend parallel to each other at least either before or after rotation. Further, the rotation axis of the holding elements may be configured as separate rotation axes provided on the respective holding elements, or as a single rotation axis common to the two holding elements.

With such a construction of the cleaning tool according to an embodiment of this invention, the sectional shape of the cleaning element can be changed according to the shape of the region to be cleaned or other similar factors by rotating the two holding elements inserted into the insert region as necessary toward each other on the rotation axis. Thus, the cleaning element can be used in a suitable form. In this case, the cleaning face is created over the entire face of the cleaning element around the cleaning element holder, and the volume of the cleaning element is increased. Therefore, dust can be trapped on the entire face of the cleaning element, so that the cleaning effect can be enhanced. Further, as the cleaning face is created over the entire face of the cleaning element, the user can use the cleaning tool without being concerned about the position of the cleaning face of the cleaning element during cleaning operation, so that the operability is improved.

In a further embodiment of the cleaning element according to this invention, preferably, the two holding elements comprise plate-like members extending parallel to each other on the same plane. Each of the plate-like members has a support surface for supporting the cleaning element when the plate-like member is inserted into the insert region, and the plate-like member can be rotated on the rotation axis such that the support surfaces of the plate-like members face each other. With such a construction, the sectional shape of the cleaning element can be changed according to the shape of the region to be cleaned or other similar factors by rotating the plate-like members inserted into the insert region as necessary toward each other on the rotation axis. Thus, the cleaning element can be used in a suitable form.

In a further embodiment of the cleaning element according to this invention, preferably, the cleaning element includes a fiber assembly having a plurality of fibers extending in a predetermined direction, and a base sheet and a holding sheet which are both formed of sheet-type nonwoven fabric. The base sheet and the holding sheet are stacked in layer and bonded together to thereby form the insert region. The fiber assembly is further overlaid on the side of the base sheet opposite the holding sheet. Further, the holding elements of the cleaning element holder which are inserted into the insert region can be rotated toward each other such that the holding sheet is positioned on the internal side of the cleaning element. As a result, the cleaning element surrounds the holding element such that the fiber assembly side of the cleaning element forms the external surface of the cleaning element.

With such a construction of the cleaning tool according to this embodiment, a cleaning face is created by the fiber assembly over the entire face of the cleaning element around the cleaning element holder. Therefore, dust can be trapped by the fiber assembly on the entire face of the cleaning element.

Further, the cleaning element according to an embodiment of this invention may be of disposable type designed for single use, disposable type designed for multiple use which can be used several times, while holding dust which has been removed from the region to be cleaned, on a brush portion, or reusable type which can be reused by washing.

As described above, according to an embodiment of this invention, in a cleaning tool having a cleaning element for wiping a region to be cleaned, particularly by provision of the construction in which the sectional shape of the cleaning element can be changed in a direction crossing the longitudinal direction of the cleaning element holder through rotation of two holding elements inserted into the insert region of the cleaning element, the cleaning element can be used in a suitable form. Therefore, the cleaning effect of the cleaning element can be enhanced.

Other objects, features and advantages of the present invention will be readily understood after reading the following detailed description together with the accompanying drawings and the claims.

DETAILED DESCRIPTION OF THE INVENTION

Each of the additional features and method steps disclosed above and below may be utilized separately or in conjunction with other features and method steps to provide improved cleaning tools and method for using such cleaning tools and devices utilized therein. Representative examples of the invention, which examples utilized many of these additional features and method steps in conjunction, will now be described in detail with reference to the drawings. This detailed description is merely intended to teach a person skilled in the art further details for practicing preferred aspects of the present teachings and is not intended to limit the scope of the invention. Only the claims define the scope of the claimed invention. Therefore, combinations of features and steps disclosed within the following detailed description may not be necessary to practice the invention in the broadest sense, and are instead taught merely to particularly describe some representative examples of the invention, which detailed description will now be given with reference to the accompanying drawings.

A representative embodiment of the present invention is now described with reference to the drawings. First, the structure of a cleaning tool 100 according to this embodiment is explained with reference to FIGS. 1 to 3. Objects to be cleaned with the cleaning tool 100 includes regions to be cleaned (floors, walls, windows, ceilings, external walls, furniture, clothes, curtains, bedding, lighting, home electric appliances, etc.) inside and outside of houses, apartments, buildings, factories, vehicles, etc. and regions of human body parts to be cleaned. These regions to be cleaned may be either flat or curved, uneven or stepped.

Figure 1:
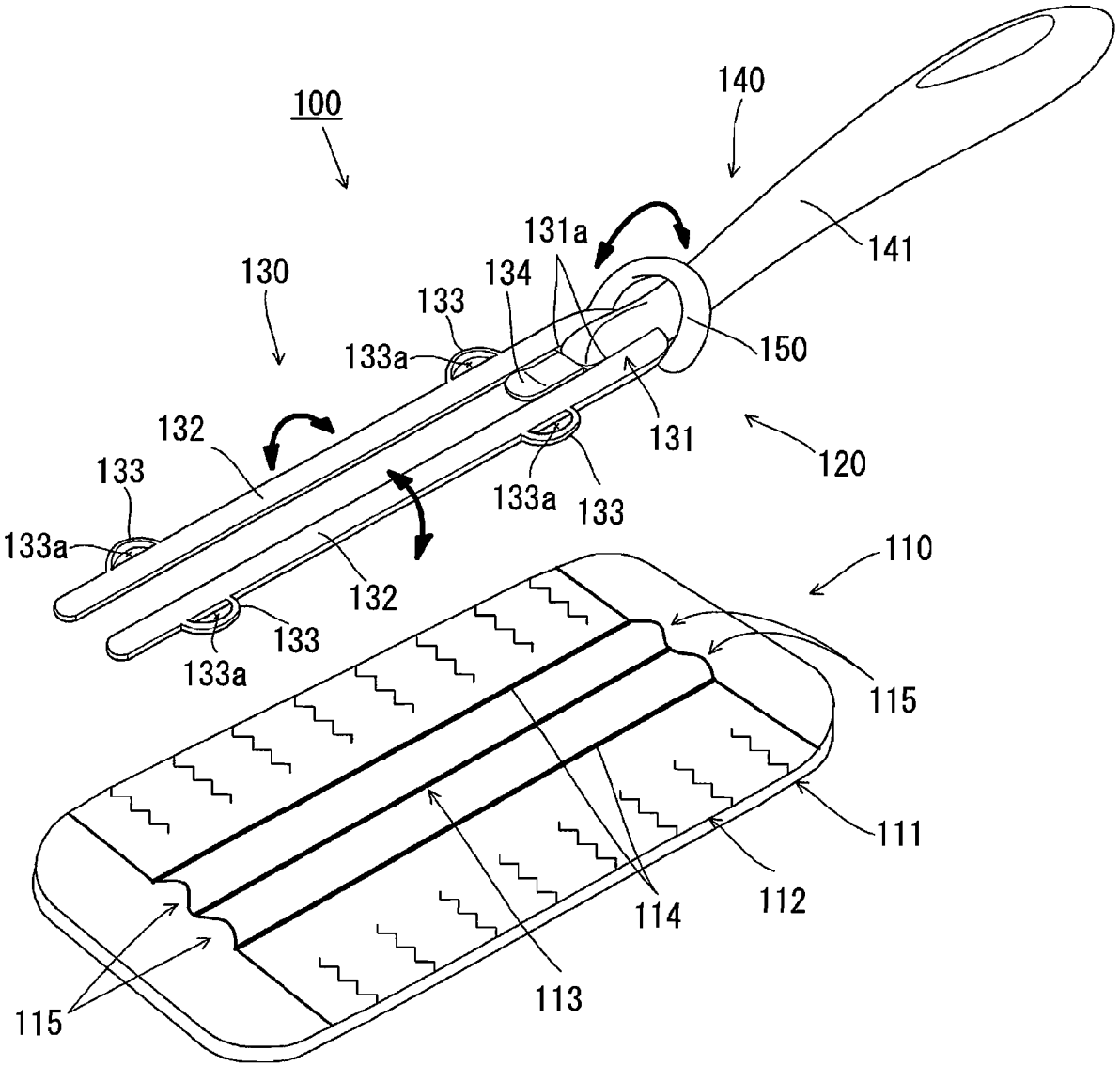
FIG. 1 is a perspective view showing a cleaning tool 100 according to an embodiment of the present invention, in a disassembled state into a cleaning element 110 and a cleaning element holder 120.

FIG. 1 shows the cleaning tool 100 according to this embodiment in perspective view, in a state disassembled into a cleaning element 110 and a cleaning element holder 120. As shown in FIG. 1, the cleaning tool 100 comprises the cleaning element 110 and the cleaning element holder 120.

The cleaning element 110 has a function of removing dirt on the region to be cleaned. The cleaning element 110 is available in a sheet-like form, and in use, it is loosened such that its volume is increased. As shown in FIG. 1, the cleaning element 110 is a sheet element having a rectangular shape in plan view and extending in a predetermined longitudinal direction (the direction of the length), which will be explained in more detail below. The cleaning element 110 includes a cleaning element body 111 and a holding sheet 112 stacked and fusion bonded together at a fusion bonded part 113 and fusion bonded parts 114 which are parallel to each other. A pair of right and left spaces demarcated by the fusion bonded parts 113, 114 form insert regions 115 into which holding portions (holding plates 132 of a holder body 130 which is described below) of the cleaning element holder 120 are inserted. The insert regions 115 are configured to have adequate size (insertion width and insertion depth) to receive the holding plates 132 of the holder body 130. The cleaning element 110 is a feature that corresponds to the "cleaning element" according to an embodiment of this invention. The cleaning element 110 may also have a square or other shape in plan view as necessary. Further, the insert regions 115 are the features that correspond to the "insert region" according to an embodiment of this invention. Each of the insert regions 115 may be formed by a single insert portion extending elongate or by a plurality of insert portions extending discontinuously.

The cleaning element holder 120 is removably attached to the cleaning element 110. The cleaning element holder 120 is an elongate member including the holder body 130 and the handle 140 connected to each other. The cleaning element holder 120 is a feature that corresponds to the "cleaning element holder" according to and embodiment of this invention. The handle 140 includes a handle body 141 extending in an elongate form and a connection 141*a* disposed between the handle body 141 and the holder body 130. The handle body 141 is a portion to be held by a user. The handle body 141 and the holder body 130 are fixedly connected at the connection 141*a*. The handle 140 and the handle body 141 here form the "grip" according to an embodiment of this invention.

The holder body 130 has a function of detachably holding the cleaning element 110. The holder body 130 includes a pair of right and left holding plates 132 and a retaining plate 134 which are formed on a base 131 of the handle 140. The holding plates 132 extend forward in the longitudinal direction from the base 131 and parallel with a predetermined spacing therebetween on the same plane. In other words, the holder body 130 has a bifurcated form. Each of the holding plates 132 has a constant width in the longitudinal direction or is tapered. The two holding plates 132 here form the "two holding elements" and the "plate-like members" according to an embodiment of this invention. The holding plates 132 can have an appropriately selected sectional shape such as a circular or polygonal section forming a rod-like shape.

Further, two projections 133 are formed on the front and rear portions of the outer edge of each of the holding plates 132. Each of the projections 133 has an elliptic contour projecting outward from the holding plate 132 and has a convexly curved projecting surface. Further, an opening or hollow portion 133*a* is formed in the central portion of the projection 133. The retaining plate 134 extends forward between the pair holding plates 132 and is convexly curved downward. The retaining plate 134 further has an engagement lug (not shown) on the underside.

The holding plates 132 can be inserted into the associated insert regions 115 and have a function of holding the cleaning element 110 in the inserted state. In the inserted state, the holding plates 132 are fitted in the associated insert regions 115 by close sliding contact, so that the cleaning element 110 is securely attached to the holding plate 132. Further, in the inserted state, the retaining plate 134 presses the cleaning element 110 from above, and the engagement lug (not shown)

formed on the underside of the retaining plate 134 serves as a stopper for preventing the cleaning element 110 from coming off. Thus, in the inserted state in which the holding plates 132 are inserted into the insert regions 115 of the cleaning element 110, the cleaning element 110 is reliably retained by the holder body 130.

Figure 2:
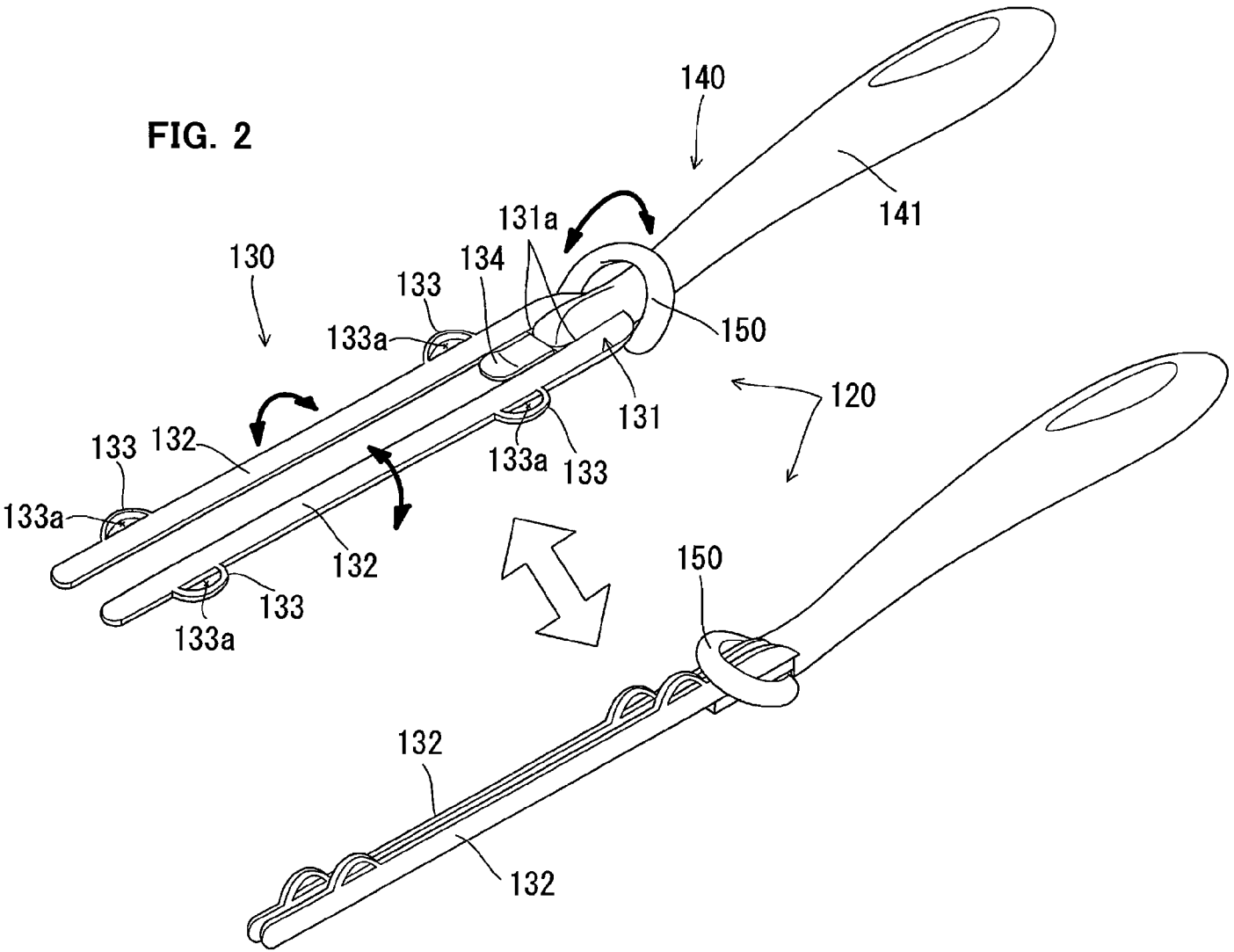
FIG. 2 is a perspective view showing the cleaning element holder 120 of FIG. 1 in a holding plate unfolded state and in a holding plate folded state.

Further, in this embodiment, each of the holding plates 132 has a hinge 131*a* on the base 131 side and can rotate via the hinge 131*a* in the directions shown by the double-headed arrow in FIG. 1, or toward and away from the other. The hinges 131*a* are rotation axes provided between the holding plates 132 and are the features that correspond to the "rotation axis" according to an embodiment of this invention. FIG. 2 is referred to as to this rotation of the holding plates 132. FIG. 2 is a perspective view showing the cleaning element holder 120 of FIG. 1 in a holding plate unfolded state and in a holding plate folded state. As shown, the cleaning element holder 120 can be changed between the holding plate unfolded state in which the holding plates 132 are unfolded, and the holding plate folded state in which the holding plates 132 are folded toward each other via the hinges 131*a*.

In order to change the cleaning element holder 120 from the holding plate unfolded state to the holding plate folded state, the user folds the holding plates 132 inward via the hinges 131*a*. At this time, the holding plates 132 are rotated such that the upper surfaces of the holding plates 132 face each other. The upper surfaces of the holding plates 132 are designed as a support surface (which is a feature that corresponds to the "support surface" according to an embodiment of this invention) for supporting the cleaning element 110 from below when the holding plates 132 are inserted into the insert regions 115. In this holding plate folded state, a rotary lever 150 is used to lock the rotational position of the holding plates 132. The rotary lever 150 is a ring-like member disposed in such a manner as to encircle the connection 141*a*. The rotary lever 150 can be rotated forward and rearward (in the directions shown by the double-headed arrow in FIG. 1) on a predetermined pivot point (not shown) provided on the connection 141*a*. Further, the rotary lever 150 can be locked in forward and rearward rotational positions by respective appropriate locking mechanisms. Therefore, when the rotary lever 150 is rotated to the forward rotational position in the folded state of the holding plates 132, the rotary lever 150 is set in the forward rotational position in which the rotary lever 150 encircles the rear end side of the holding plates 132. As a result, the folded holding plates 132 are pressed in a cramping manner from outward by the inner surface of the rotary lever 150 and thus locked in the rotational position.

In order to change the cleaning element holder 120 from the holding plate folded state to the holding plate unfolded state, first, the user turns the rotary lever 150 from the forward rotational position to the rearward rotational position, so that the lock of the rotational position of the holding plates 132 is released. Thereafter, the user unfolds the folded holding plates 132 outward via the hinges 131*a*.

The cleaning element holder 120 may have an appropriately selected structure, such as a structure in which the holder body 130 and the handle 140 (the handle body 141 and the connection 141*a*) are separately formed and designed to be assembled together, a structure in which the holder body 130 and the handle 140 are integrally formed, and a structure in which two of the holder body 130, the handle 140 and the connection 141*a* are integrally formed.

Figure 3:
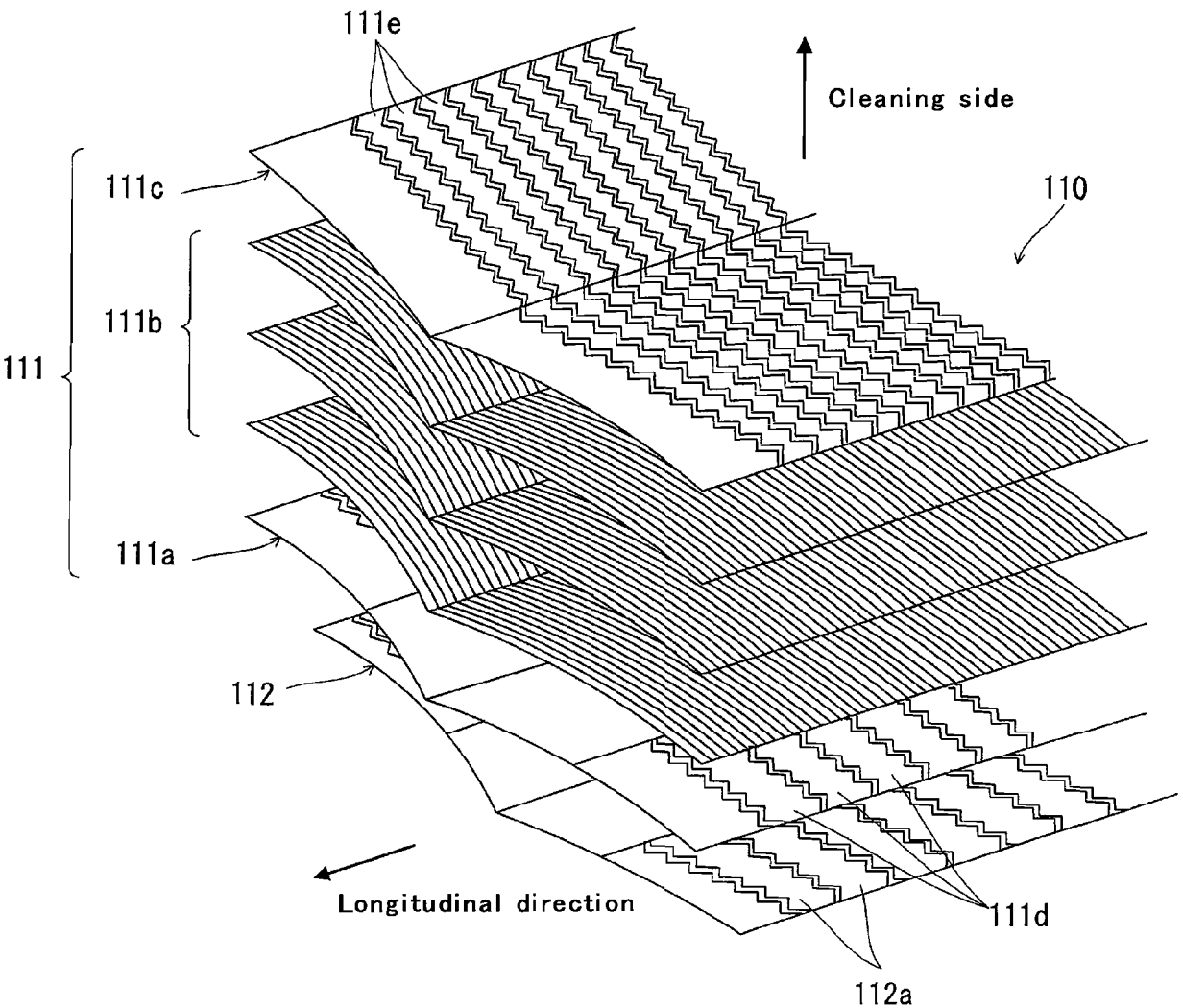
FIG. 3 is a perspective view of the cleaning element 110 of FIG. 1 which is shown separated into component elements.

Referring to FIG. 3, the structure of the cleaning element 110 is specifically described. FIG. 3 is a perspective view of a layered part 110*a* of the cleaning element 110 of FIG. 1 which is shown separated into component elements.

As shown in FIG. 3, in the cleaning element 110 of this embodiment, the holding sheet 112 is overlaid on the cleaning element body 111 on the cleaning side (which is also referred to as the "lower region side" or the "back"). Further, the cleaning element body 111 has a cleaning side sheet 111*c*, a fiber assembly 111*b* and a base sheet 111*a* placed one on the other in this order from the cleaning side (lower region side). In this case, the holding sheet 112 and the base sheet 111*a* are overlaid on the side of the fiber assembly 111*b* opposite the cleaning side sheet 111*c* (lower region side sheet) and form an upper region side sheet.

The base sheet 111*a*, the fiber assembly 111*b* and the cleaning side sheet 111*c* which form the cleaning element body 111 have the same rectangular sheet-like form in plan view and extend in a longitudinal direction of the cleaning element 110. The fiber assembly 111*b* and the cleaning side sheet 111*c* form a brush-like part having a dirt removing function, which is also referred to as the "brush portion". The cleaning element 110 may be of disposable type designed for single use, disposable type designed for multiple use which can be used several times, while holding dust which has been removed from the region to be cleaned, on the brush portion, or reusable type which can be reused by washing. Further, in this embodiment, the cleaning element body 111 of the cleaning element 110 is described as a structure having the base sheet 111*a*, the fiber assembly 111*b* and the cleaning side sheet 111*c* stacked in layer, but may be constructed as a structure having an additional fiber layer and/or sheet.

The holding sheet 112, the base sheet 111*a* and the cleaning side sheet 111*c* have a plurality of zigzag strips (strip portions) extending in a direction crossing the longitudinal direction of the cleaning element 110. Specifically, the holding sheet 112 comprises a plurality of strips 112*a* arranged in parallel and extending in a direction crossing the longitudinal direction of the cleaning element 110. The base sheet 111*a* comprises a plurality of strips 111*d* arranged in parallel and extending in a direction crossing the longitudinal direction of the cleaning element 110. The cleaning side sheet 111*c* comprises a plurality of strips 111*e* arranged in parallel and extending in a direction crossing the longitudinal direction of the cleaning element 110. An improved structure which can easily trap dust and thus has a higher cleaning function can be realized by the zigzag strips of the sheets. The strips may have the same kind or different kinds of shape appropriately selected from various shapes, such as zigzag, linear and curved shapes.

The construction of the nonwoven fabric forming the above-described base sheet 111*a*, cleaning side sheet 111*c* and holding sheet 112 and the construction of the fiber assembly 111*b* are now explained in detail.

The base sheet 111*a*, the cleaning side sheet 111*c* and the holding sheet 112 can typically be formed of sheet-type nonwoven fabric comprising thermal melting fibers (thermoplastic fibers) and thus referred to as nonwoven fabric sheet. The base sheet 111*a* and the holding sheet 112 herein form the "sheet-type nonwoven fabric" according to an embodiment of this invention. The nonwoven fabric has a sheet-like configuration formed by fixing or entangling fibers by mechanical, chemical or heat treatment. The nonwoven fabric partly includes thermoplastic fibers and thus can be fusion bonded. Further, the nonwoven fabric has a plurality of strips. Examples of the thermal melting fibers (thermoplastic fibers) include polyethylene, polypropylene and polyethylene terephthalate. The nonwoven fabric may be manufactured by through-air bonding, spun bonding, thermal bonding, spun lacing, point bonding, melt blowing, stitch bonding, chemical bonding, needle punching or other similar processes. This nonwoven fabric is a feature that corresponds to the "nonwoven fabric" according to an embodiment of this invention. In order to enhance the dust wiping function, it is preferred to use a nonwoven fabric having higher rigidity. Further, as an alternative to or in addition to the nonwoven fabric, a material to be worked into strips, such as urethane, sponge, woven fabric, net and split cloth, may be used.

The fiber assembly 111*b* is a single fiber structure formed by fibers, a fiber structure having fibers aligned in the length direction and/or the radial direction (twist yarn, spun yarn, yarn to which a plurality of filaments are partially connected), or an assembly of the fiber structures. The fiber assembly 111*b* partially includes thermoplastic fibers and can be fusion bonded. The fibers forming the fiber assembly 111*b* are elements of yarn, textile or the like and defined as being thin and flexible fibers having a substantially longer length compared with the thickness. Typically, a long continuous fiber is defined as a filament and a short fiber as a staple. The proximal ends of the fibers of the fiber assembly 111*b* are bonded at the fusion bonded parts 113 and 114. The fibers of the fiber assembly 111*b* each have one end fixed at the fusion bonded parts and the other free end (distal end) on the opposite side. The fibers of the fiber assembly 111*b* extend in a direction crossing the longitudinal direction of the cleaning element 110 (or the fiber assembly 111*b*). The fiber assembly 111*b* extending in a direction crossing the longitudinal direction of the cleaning element 110 is a feature that corresponds to the "fiber assembly comprising a plurality of fibers extending in the predetermined direction" according to this embodiment. The fiber assembly 111*b* is also referred to as the "fiber bundle" having a plurality of fibers in a bundle.

In the representative example shown in FIG. 3, the fiber assembly 111*b* comprises three fiber layers, but it may comprise one or more fiber layers as necessary. Preferably, the fiber assembly 111*b* has a planar structure having a predetermined flat or curved region and has a three-dimensional form having a certain thickness or has a thin sheet-like form. The "fiber assembly" is typically formed of polyethylene (PE), polypropylene (PP), polyethylene terephthalate (PET), nylon, rayon or the like. In practical use, an assembly of filaments formed by opening a tow is frequently used as the fiber assembly. It is particularly preferable that the fiber assembly comprises conjugated fibers having a core of polypropylene (PP) or polyethylene (PE) and a core covering sheath of polyethylene (PE). Further, the filaments of the fiber assembly are preferred to have a fineness of 1 to 50 dtex, more preferably 2 to 10 dtex. The individual fiber assembly may contain fibers of substantially the same fineness or of different finenesses.

Further, in order to enhance the dust wiping function, it is preferred to use a fiber assembly including fibers having higher rigidity or fibers having higher fineness. It is further preferred that the fiber assembly has crimped fibers. Here, the crimped fibers are fibers subjected to a predetermined crimping process and easily entangled with each other. With the fibers being crimped, the fiber assembly becomes bulkier than before the holder is attached thereto, and dust can be easily captured by the crimped portions. This structure can be realized especially by using crimped fibers opened from a tow.

For the fiber assembly, flat yarns or split yarns may also be employed. The flat yarns are prepared by slitting a film into tapes and by stretching the tapes in the longitudinal direction. The split yarns are prepared by splitting a thermoplastic film resin in the direction perpendicular to the orientation direction of the resin so that the film is fibrillated and interconnected into a net shape. Alternatively, a nonwoven fabric which is bulky and has low fiber density, such as a through-air bonded nonwoven fabric, may be employed to form the fiber assembly.

The kinds and numbers of the component parts of the cleaning element 110 are not limited to those described in the above-described example, and can be selected as necessary.

Figure 4:
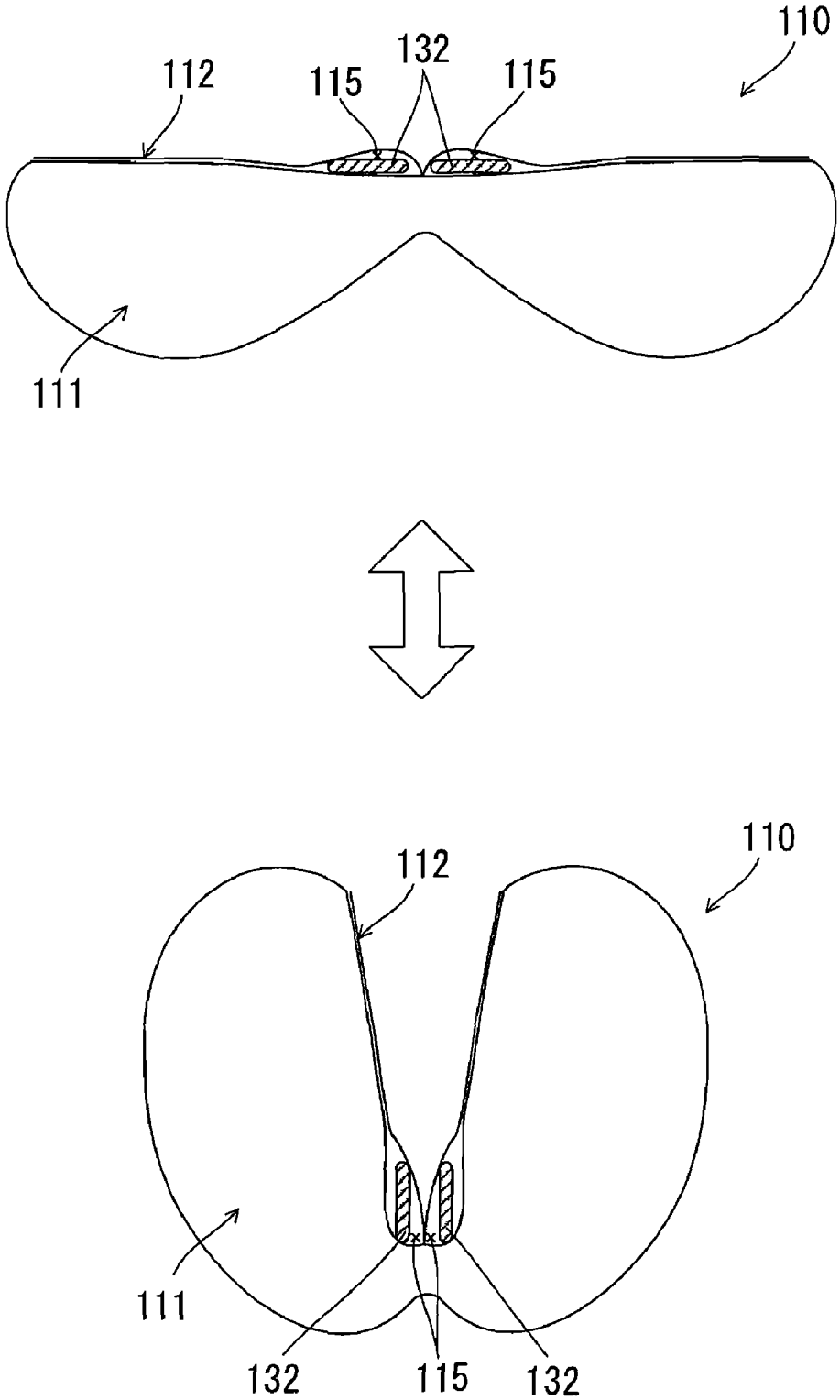
FIG. 4 is a schematic view showing the cleaning element 110 when holding plates 132 are in the holding plate unfolded state and in the holding plate folded state.

Operation of the cleaning tool 100 having the above-described construction is described with reference to FIGS. 2 and 4. FIG. 4 schematically shows the cleaning element 110 in the holding plate unfolded state and in the holding plate folded state of the holding plates 132 in this embodiment.

In using the cleaning tool 100 to wipe a region to be cleaned, in order to attach the cleaning element 110 and the cleaning element holder 120 to each other, first, the cleaning element holder 120 is set in the holding plate unfolded state as shown in FIG. 2. Then, the holding plates 132 of the holder body 130 are inserted into the insert regions 115 of the cleaning element 110. Thus, the cleaning element 110 and the cleaning element holder 120 are attached to each other. At this time, preferably, in order to enhance the cleaning effect, the cleaning element 110 is fluffed as necessary so that the volume of the cleaning element 110 is increased. In the holding plate unfolded state of the cleaning element holder 120, the cleaning element 110 is set in first cleaning mode as shown in FIG. 4. In the first cleaning mode, the lower surface of the cleaning element forms the cleaning face of the cleaning element 110 to be used for wiping.

Further, by rotating the holding plates 132 inserted into the insert regions 115 and the rotary lever 150, the cleaning element holder 120 can be changed from the holding plate unfolded state to the holding plate folded state. At this time, the holding plates 132 inserted into the insert regions 115 can be rotated in parallel toward each other around the longitudinal axis of the holder body 130 on the hinges 131*a* disposed between the holding plates 132 such that the holding sheet 112 is positioned on the internal side of the cleaning element. Through this rotation, the sectional shape of the cleaning element 110 can be changed in the direction crossing the longitudinal direction of the holder body 130. Further, in order to realize the "parallel" state of the holding plates 132 here, it is only necessary to create the state in which the two holding plates 132 are arranged in parallel to each other. Thus, the parallel state widely embraces the state in which the holding plates 132 extend substantially in the same direction, and the state in which the holding plates 132 extend parallel to each other at least either before or after rotation. Further, the rotation axis of the holding plates 132 may be configured as separate rotation axes like the hinges 131*a* which are separately provided on the respective holding plates 132, or as a single rotation axis common to the two holding plates 132.

In the holding plate folded state of the cleaning element holder 120, the cleaning element 110 is set in second cleaning mode as shown in FIG. 4. In the second cleaning mode, the cleaning element 110 surrounds the holding plates 132 such that the fiber assembly 111*b* side of the cleaning element 110 forms the external surface of the cleaning element. Thus, the cleaning element 110 entirely surrounds the holding plates 132, so that the cleaning face of the cleaning element 110 to be used for wiping is formed substantially by the entire external surface of the cleaning element 110. As a result, the volume of the sheet-type cleaning element 110 can be increased, and dust can be trapped on the entire face of the cleaning element. Further, the user can use the cleaning tool without being concerned about the position of the cleaning face of the cleaning element during cleaning operation. Therefore, the cleaning effect can be enhanced.

The present invention is not limited to the embodiment as described above, but rather, may be added to, changed, replaced with alternatives or otherwise modified. For example, the following provisions can be made in application of this embodiment.

Figure 5:
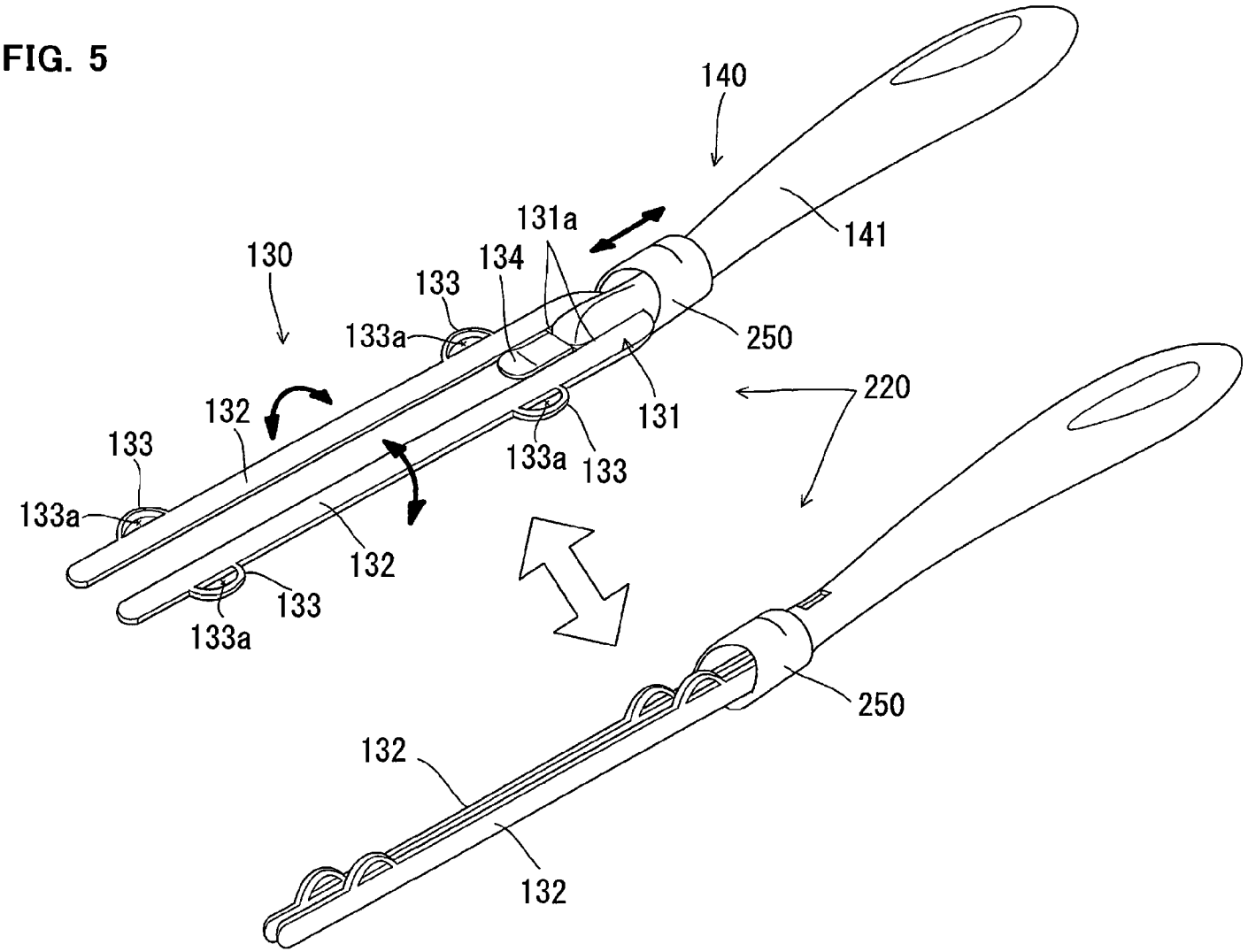
FIG. 5 is a perspective view showing a cleaning element holder 220 in the holding plate unfolded state and in the holding plate folded state.
Figure 6:
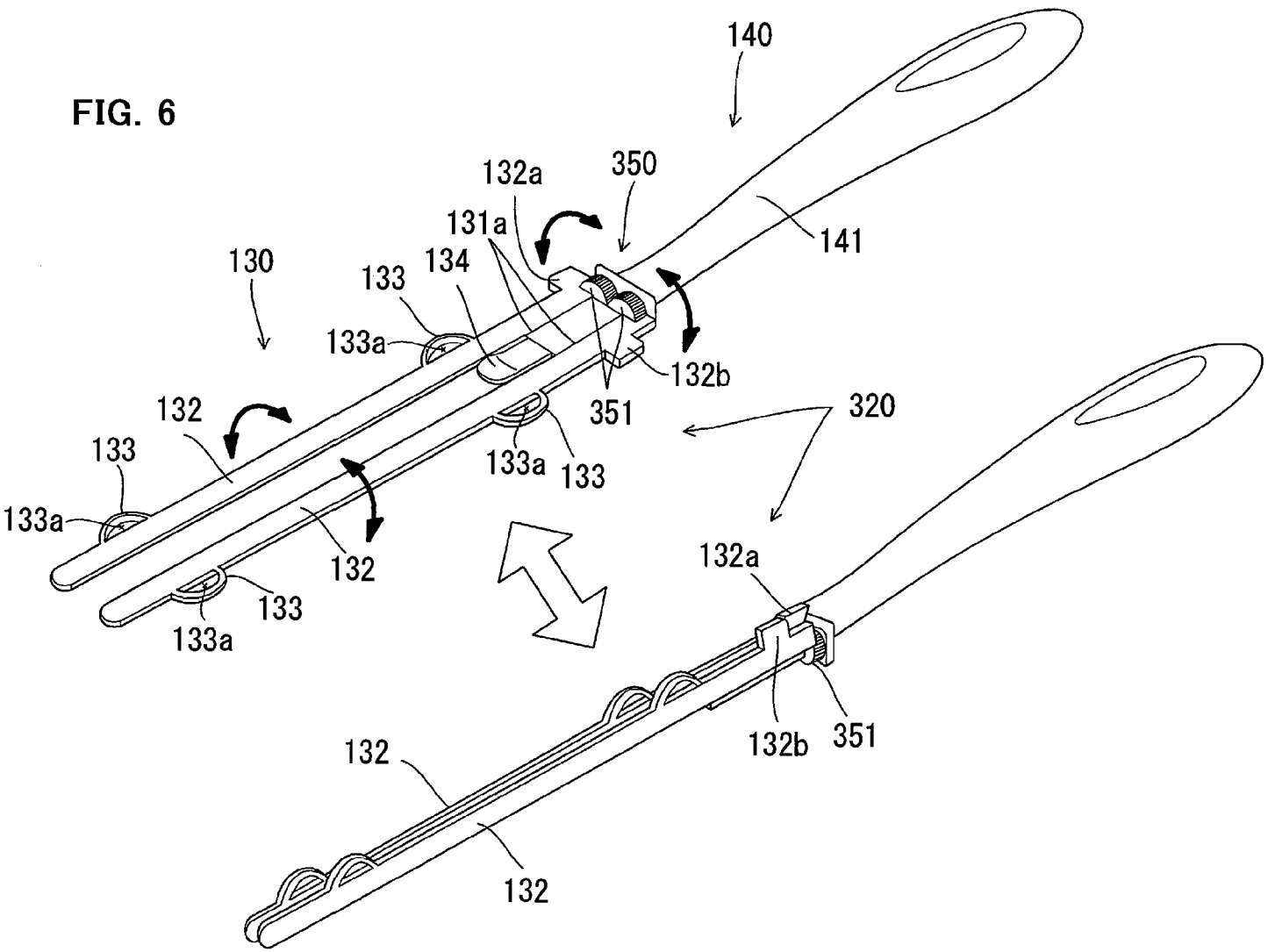
FIG. 6 is a perspective view showing a cleaning element holder 320 in the holding plate unfolded state and in the holding plate folded state.

In this invention, it is essential that the holding plates 132 of the cleaning element holder 120 can be set in the holding plate unfolded state and the holding plate folded state as shown in FIG. 4. Therefore, cleaning element holders having a construction which is different from that of the cleaning element holder 120 in the above-described embodiment can be appropriately used. Other embodiments of the "cleaning element holder" are described with reference to FIGS. 5 and 6. In FIGS. 5 and 6, parts identical to those in the above embodiment shown in FIG. 2 are given like numerals as in the first embodiment and will not be described.

FIG. 5 is a perspective view showing a cleaning element holder 220 of a different embodiment in a holding plate unfolded state and in a holding plate folded state. The cleaning element holder 220 substantially has the same construction as the cleaning element holder 120 except for a slide button 250 which is used in place of the rotary lever 150. The slide button 250 is a cylindrical member disposed in such a manner as to encircle the connection 141*a*. The slide button 250 can be slid forward and rearward (in the directions shown by the double-headed arrow in FIG. 1). Further, the slide button 250 can be locked in forward and rearward slide positions by respective appropriate locking mechanisms.

When the slide button 250 is slid to the forward slide position in the folded state of the holding plates 132, the slide button 250 is set in the forward slide position in which the slide button 250 encircles the rear end side of the holding plates 132. As a result, the folded holding plates 132 are pressed in a cramping manner from outward by the inner surface of the slide button 250 and thus locked in the slide position. In order to change the cleaning element holder 220 from the holding plate folded state to the holding plate unfolded state, first, the user moves the slide button 250 from the forward slide position to the rearward slide position, so that the lock of the rotational position of the holding plates 132 is released. Thereafter, the user unfolds the folded holding plates 132 outward via the hinges 131*a*. Like the cleaning element holder 120, the cleaning element holder 220 having such a construction can also be changed between the holding plate folded state and the holding plate unfolded state, so that the cleaning element 110 can be set in the first and second cleaning modes as shown in FIG. 4. Thus, the cleaning effect can also be enhanced.

FIG. 6 is a perspective view showing a cleaning element holder 320 of a different embodiment in a holding plate unfolded state and in a holding plate folded state. The cleaning element holder 320 substantially has the same construction as the cleaning element holders 120 and 220 except for a gear mechanism 350 which is used in place of the rotary lever 150 or the slide button 250. The gear mechanism 350 includes a pair of right and left rotary gears 351, 352 having gear teeth on the outer periphery and rotatably disposed in engagement with each other. The rotary gear 351 is engaged with a gear groove (not shown) formed in one of the holding plates 132, and the rotary gear 352 is engaged with a gear groove (not shown) formed in the other holding plate 132.

When a lug 132*a* of the one holding plate 132 or a lug 132*b* of the other holding plate 132 is rotated inward, the holding plates 132 are folded toward each other via the hinges 131*a* and set in the holding plate folded state, while being kept in engagement with the rotary gears 351, 352 at the lugs 132*a*, 132*b*. Further, the folded holding plates 132 are locked in the rotational position by the resistance of gear engagement of the rotary gears 351, 352 and an appropriate lock mechanism for locking the lugs 132*a*, 132*b* to each other. On the other hand, when the user turns the lug 132*a* or 132*b* of the cleaning holder 320 outward in the holding plate folded state, the holding plates 132 are unfolded away from each other via the hinges 131*a* and set in the holding plate unfolded state, while being kept in engagement with the rotary gears 351, 352 at the lugs 132*a*, 132*b*. Like the cleaning element holders 120, 220, the cleaning element holder 320 having such a construction can also be changed between the holding plate folded state and the holding plate unfolded state, so that the cleaning element 110 can be set in the first and second cleaning modes as shown in FIG. 4. Thus, the cleaning effect can also be enhanced.

Further, in the above embodiment, the cleaning element 110 is described as being formed by the sheet-type nonwoven fabric and the fiber assembly. In this invention, however, the cleaning element may be formed only by sheet-type nonwoven fabric.

Further, in the above-embodiment, both of the holding plates 132 can be moved with respect to the grip in the form of the handle body 141. In this invention, however, it may also be constructed such that either one of the holding plates 132 can be moved with respect to the handle body 141.

While the invention has been particularly shown and described with reference to preferred embodiments thereof, it will be understood by those skilled in the art that various changes in form and details may be made therein without departing from the spirit and scope of the invention.

What we claim is:

1. A cleaning tool for wiping a region to be cleaned, comprising:

an elongate cleaning element holder, and a cleaning element to be attached to the cleaning element holder, wherein:

the cleaning element holder has a handle to be held by a user and two holding elements extending parallel in a longitudinal direction from the handle, the holding elements being adapted to be inserted into an insert region of the cleaning element to thereby hold the cleaning element, hinges provided on side surfaces of the handle by which the two holding elements are coupled to the handle, each of the two holding elements of the cleaning element holder being separately and independently rotatable with respect to the handle and separately and independently rotatable with respect to one another in parallel toward each other around an axis that extents in the longitudinal direction, each holding element being on a rotation axis disposed between the holding elements, wherein the rotation axes of the two holding elements are non-coincidental, and whereby, through the rotation of the two holding elements inserted into the insert region, the sectional shape of the cleaning element can be changed in a direction crossing the longitudinal direction of the cleaning element holder.

2. The cleaning tool according to claim 1, wherein the two holding elements comprise plate-like members extending parallel to each other on the same plane, each of the plate-like members has a support surface for supporting the cleaning element when the plate-like member is inserted into the insert region, and the plate-like member can be rotated on the rotation axis such that the support surfaces of the plate-like members face each other.

3. The cleaning tool according to claim 1, wherein:

the cleaning element includes a fiber assembly having a plurality of fibers extending in a predetermined direction, and a base sheet and a holding sheet which are both formed of sheet-type nonwoven fabric, the base sheet and the holding sheet being stacked in layer and bonded together to thereby form the insert region, and the fiber assembly being further overlaid on the side of the base sheet opposite the holding sheet, the holding elements of the cleaning element holder which are inserted into the insert region can be rotated toward each other such that the holding sheet is positioned on the internal side of the cleaning element, whereby the cleaning element surrounds the holding element such that the fiber assembly side of the cleaning element forms the external surface of the cleaning element.

4. The cleaning tool according to claim 1, wherein when the two holding elements are similarly rotated, the cleaning tool has a symmetrical shape about a longitudinal axis.

* * * * *